US007509741B2

(12) United States Patent
Shimizu

(10) Patent No.: US 7,509,741 B2
(45) Date of Patent: Mar. 31, 2009

(54) ROTARY TYPE ELECTRIC SHAVER

(75) Inventor: Tetsuhiko Shimizu, Matsumoto (JP)

(73) Assignee: Izumi Products Company, Nagano (JP)

( * ) Notice: Subject to any disclaimer, the term of this patent is extended or adjusted under 35 U.S.C. 154(b) by 306 days.

(21) Appl. No.: 11/334,882

(22) Filed: Jan. 19, 2006

(65) Prior Publication Data

US 2006/0156548 A1 Jul. 20, 2006

(30) Foreign Application Priority Data

Jan. 19, 2005 (JP) ..... 2005-011904

(51) Int. Cl.
*B26B 19/14* (2006.01)
*B26B 19/20* (2006.01)

(52) U.S. Cl. ..... 30/43.6; 30/346.51

(58) Field of Classification Search ..... 30/43.4–43.6, 30/346.51, 347, 356
See application file for complete search history.

(56) References Cited

U.S. PATENT DOCUMENTS

| | | | | |
|---|---|---|---|---|
| 1,362,766 | A | 12/1920 | McGargill | |
| 2,199,768 | A * | 5/1940 | Whitton | 30/43.6 |
| 2,273,524 | A * | 2/1942 | Jensen et al. | 30/43.92 |
| 2,343,553 | A * | 3/1944 | Dam et al. | 30/43.6 |
| 2,494,464 | A * | 1/1950 | De Lee et al. | 30/43.6 |
| 2,533,979 | A * | 12/1950 | Vivie | 30/346.51 |
| 2,663,297 | A | 1/1953 | Turnberg | |
| 3,264,733 | A * | 8/1966 | Tiemes et al. | 30/34.1 |
| 3,281,937 | A * | 11/1966 | Driessen et al. | 30/346.51 |
| 4,156,426 | A | 5/1979 | Gold | |
| 4,367,735 | A | 1/1983 | Dali | |
| 4,422,456 | A | 12/1983 | Tiep | |
| 4,915,105 | A | 4/1990 | Lee | |
| 4,919,128 | A | 4/1990 | Kopala et al. | |
| 4,996,983 | A | 3/1991 | AmRhein | |
| 5,046,491 | A | 9/1991 | Derrick | |
| 5,137,017 | A | 8/1992 | Salter | |
| 5,269,296 | A | 12/1993 | Landis | |
| 5,335,659 | A | 8/1994 | Pologe | |
| 5,400,776 | A | 3/1995 | Bartholomew | |
| 5,477,852 | A | 12/1995 | Landis et al. | |

(Continued)

FOREIGN PATENT DOCUMENTS

| | | |
|---|---|---|
| EP | 0 652 086 | 5/1995 |

(Continued)

*Primary Examiner*—Boyer D. Ashley
*Assistant Examiner*—Edward Landrum
(74) *Attorney, Agent, or Firm*—William L. Androlia; H. Henry Koda

(57) ABSTRACT

Electric rotary shaver including an outer cutter 14, in which a ring-shaped groove 26 is formed in the top portion and two ring-shaped inner cutter running tracks 34 are formed in the interior surface, and an inner cutter 16, in which a plurality of cutter blades 40 are provided that make sliding contact with the inner cutter running tracks 34 of the outer cutter 14. A sliding surface where the cutter blades of the inner cutter make a sliding contact with the inner cutter running track of the outer cutter is set on a plane C perpendicular to the center axis line (A), and the thickness of the top portion of the outer cutter 14 is such that the portions near the ring-shaped groove 26 are made thinner or thicker than the other part of the top portion on at least a part of the circumference.

3 Claims, 5 Drawing Sheets

U.S. PATENT DOCUMENTS

| | | | | |
|---|---|---|---|---|
| 5,513,634 | A | 5/1996 | Jackson | |
| 5,533,506 | A | 7/1996 | Wood | |
| 5,682,881 | A | 11/1997 | Winthrop et al. | |
| 5,687,715 | A | 11/1997 | Landis et al. | |
| 5,724,965 | A | 3/1998 | Handke et al. | |
| 5,794,619 | A | 8/1998 | Edelman et al. | |
| 5,928,189 | A | 7/1999 | Phillips et al. | |
| 6,085,421 | A * | 7/2000 | Jorna et al. | 30/43.6 |
| 6,165,133 | A | 12/2000 | Rapoport et al. | |
| 6,212,776 | B1 * | 4/2001 | Izumi et al. | 30/43.4 |
| 6,213,955 | B1 | 4/2001 | Karakasoglu et al. | |
| 6,298,850 | B1 | 10/2001 | Argraves | |
| 6,354,293 | B1 | 3/2002 | Madison | |
| 6,422,240 | B1 | 7/2002 | Levitsky et al. | |
| 6,439,234 | B1 | 8/2002 | Curti et al. | |
| 6,478,026 | B1 | 11/2002 | Wood | |
| 6,595,215 | B2 | 7/2003 | Wood | |
| 6,679,265 | B2 | 1/2004 | Strickland et al. | |
| 6,776,162 | B2 | 8/2004 | Wood | |
| 6,807,967 | B2 | 10/2004 | Wood | |
| 6,863,069 | B2 | 3/2005 | Wood | |
| 6,994,089 | B2 | 2/2006 | Wood | |
| 6,997,177 | B2 | 2/2006 | Wood | |
| 6,997,187 | B2 | 2/2006 | Wood et al. | |
| 7,000,613 | B2 | 2/2006 | Wood et al. | |
| 7,047,974 | B2 | 5/2006 | Strickland et al. | |
| 7,059,328 | B2 | 6/2006 | Wood | |
| 7,188,624 | B2 | 3/2007 | Wood | |
| 7,191,781 | B2 | 3/2007 | Wood | |
| 7,234,465 | B2 | 6/2007 | Wood | |
| 2002/0059935 | A1 | 5/2002 | Wood | |
| 2002/0162558 | A1 | 11/2002 | Noble | |
| 2004/0182397 | A1 | 9/2004 | Wood | |
| 2005/0028821 | A1 | 2/2005 | Wood et al. | |
| 2005/0039757 | A1 | 2/2005 | Wood | |
| 2005/0121037 | A1 | 6/2005 | Wood | |
| 2005/0133040 | A1 | 6/2005 | Wood | |
| 2005/0235999 | A1 | 10/2005 | Wood et al. | |
| 2005/0252515 | A1 | 11/2005 | Wood | |
| 2007/0137653 | A1 | 6/2007 | Wood | |

FOREIGN PATENT DOCUMENTS

| | | |
|---|---|---|
| EP | 0 885 696 | 12/1998 |
| JP | 7-185148 | 7/1995 |
| JP | 11-4980 | 1/1999 |
| NL | 9 001 560 | 2/1992 |

* cited by examiner

ROTARY TYPE ELECTRIC SHAVER

BACKGROUND OF THE INVENTION

1. Technical Field

The present invention relates to a rotary type electric shaver in which an inner cutter(s) rotates while making a sliding contact with an interior surface of an outer cutter(s), so that whiskers (or hair) that advance into hair introduction openings extending in substantially a radial direction in the top portion of the outer cutter is cut by the inner cutter(s).

2. Description of the Related Art

In electric rotary shaves, when, during shaving, plural slit-shaped hair introduction openings (or "slits") of the outer cutter of a shaver is firmly pressed against skin, the skin would enter into the slits and be cut by the inner cutter (occasionally cut too deeply), causing a burning feeling in the skin after finishing the shaving. This sort of problem can be prevented by using outer cutters which are made thick. Here, making the outer cutter thick means to increase the dimension of the thickness of the ribs that are on both sides of each radial direction slit (the dimension in the direction parallel to the rotational axis of the inner cutter). However, increase of the thickness of the outer cutter results in expansion of the distance between the skin and the inner cutter, causing another problem that it is not possible to cut hair deep enough.

A proposal for preventing the problems described above is disclosed in, for instance, Japanese Patent Application Laid-Open (Kokai) No. H11-4980. In the shaver disclosed in this related art, as shown in FIG. 7, a plurality of concentric circular inner cutter running tracks 2*a* and 2*b* are formed in the outer cutter 1; and slit-shaped blades (ribs) 3*a* are formed in the outer inner cutter running track 2*a*, and slit-shaped blades (sits) 3*b* are formed in the inside inner cutter running track 2*b*, with the outside slit-shaped blades (ribs) 3*a* are thicker than the inside slit-shaped blades (ribs) 3*b*.

Generally, when the outer cutter(s) (or the shaver) is moved around while being pressed against the shaving part of the face during the shaving, the skin tends to come into contact with the outer periphery of the outer cutter(s), and wrinkles occur; and the pressing force becomes larger at the outer peripheral side of the outer cutter.

In view of this problem, in the electric shaver disclosed in Japanese Patent Application Laid-Open (Kokai) No. H11-4980, the peripheral side of the outer cutter is made thicker to prevent excessive deep shaving. Since the pressing force becomes smaller in the inner peripheral side, the inner peripheral side of the outer cutter is made thinner, so that shaving with appropriate depth can be made on the inner peripheral side.

Japanese Patent Application Laid-Open (Kokai) No. H7-185148 teaches an electric shaver in which the sliding surface where the cutter blade of the inner cutter make a sliding contact with the inner cutter running track of the outer cutter has a constant thickness in the vertical cross-section (that includes the rotational center axis) and projects upward in a convex arc shape.

The electric shaver disclosed in Japanese Patent Application Laid-Open (Kokai) No. H11-4980 is designed based upon a use state of a shaver in which, when the outer cutter (or the shaver) is moved around while being firmly pressed against the skin, the skin wrinkles at the outer peripheral edge of the outer cutter, and the pressing force becomes larger. In an actual use, however, the outer cutter (or the shaver) is often moved around while touching the skin lightly; and in this case, large wrinkles would not occur on the outer peripheral edge of the outer cutter, and the shaving performance tends to be poor.

On the other hand, in the electric shaver disclosed in Japanese Patent Application Laid-Open (Kokai) No. H7-185148, the sliding surface where the cutter blades of the inner cutter make a sliding contact with the inner cutter running track of the outer cutter has a curvature that is convex upward (in an imaginary radial cross-section that includes the rotational center axis of the inner cutter). Accordingly, the problem is that manufacturing of the outer cutter is not easy, and the productivity is poor. Furthermore, the whetstone that grinds the sliding surface (cutting surface) that has an outwardly convex shape must be processed in advance so that the whetstone has a grinding surface that matches the curvature of the curved sliding surface; as a result, the durability of the whetstone also becomes an issue.

BRIEF SUMMARY OF THE INVENTION

The present invention is to solve the problems described above.

The object of the present invention is to provide a rotary type electric shaver in which an excellent shaving feeling is obtainable even when the outer cutter is used while being lightly pressed against the skin, the sliding surface (cutting surface) where the cutter blades of the inner cutter make a sliding contact with the inner surface of the outer cutter can be polished easily and efficiently by whetstone, and the durability of whetstone is greatly increased.

The above object is accomplished by a unique structure of the present invention for a rotary type electric shaver that includes a shaver main body; an outer cutter housing provided on the shaver main body; a cutter unit comprised of an outer cutter provided in the outer cutter housing and formed in a round top portion thereof with a plurality of slit-shaped hair introduction openings extending in substantially the radial direction, and an inner cutter disposed inside the outer cutter and rotationally driven by a motor provided inside the shaver main body; and in the present invention, the outer cutter is formed with a ring-shaped groove, which is formed in the top portion and concentric with a center axis line that forms a rotational center of the inner cutter, and two ring-shaped inner cutter running tracks, which are formed in the interior surface of the outer cutter so as to be concentric with the center axis line and on both sides of the ring-shaped groove, the inner cutter is provided with a plurality of cutter blades that make sliding contact with the track surfaces of the inner cutter running tracks; and wherein a sliding surface where the cutter blades of the inner cutter make a sliding contact with the inner cutter running track of the outer cutter (the sliding surface thus being defined by the track surfaces of the inner cutter running tracks and the cutter blades of the inner cutter) is set on an (imaginary) plane that is perpendicular to the center axis line, and the portions near or alongside the ring-shaped groove in the top potion of the outer cutter differ in thickness (thicker or thinner) from the circumferential portions of the top portion for at least part of the circumferential direction of the outer cutter.

As seen from the above, in the shaver of the present invention, the thickness of the top portion of the outer cutter is formed such that the ring-shaped groove side (or the portion near or alongside the ring-shaped groove) is made thicker on at least part of its circumferential direction. In addition, the sliding surface where the cutter blades of the inner cutter make a sliding contact with the inner cutter running track of the outer cutter (thus being defined by the track surfaces of the inner cutter running tracks and the cutter blades of the inner cutter) is positioned on a plane (or flat or level surface) that is perpendicular to the center axis line (of the inner and outer cutters). Accordingly, the top portion of the outer cutter is convex in a vertical cross-section (which is a cross section on an imaginary radial plane that includes the center axis line), and the outer cutter (or the top portion of the outer cutter) is thicker near or alongside the ring-shaped groove and is thinner near or alongside the inner and outer circumferential edge portions that are distant from the ring-shaped groove. In the present invention, the thickness of the top portion of the outer cutter, contradictory to the above, can be formed such that the ring-shaped groove side (or the portion near or alongside the ring-shaped groove) is made thinner on at least part of its circumferential direction, so that the top portion of the outer cutter is concave with the portions near or alongside the ring-shaped groove is thinner than the portions near or alongside the inner and outer circumferential edge portions that are distant from the ring-shaped groove.

Therefore, when the top portion the outer cutter is pressed against the skin substantially perpendicularly, the higher portion of the top portion of the outer cutter (the thicker portion, in other words the central portion if the top portion is convex and the inner and outer circumferential edge portions if the top portion is concave) touches the skin first.

In this state, hair enters into the hair introduction opening (slit) of the higher (thicker) portion of the outer cutter, and some hair that has entered is cut here; and when the outer cutter (or the shaver) is moved from this state while touching the skin surface, the hair entered into the hair introduction opening of the thicker portion of the outer cutter is introduced to the lower (or thinner) portion of the outer cutter. Therefore, the remaining hair not cut by the thicker portion of the outer cutter is shaved with sufficient depth. During this process, hair is smoothly introduced from the hair introduction opening of the thicker portion of the outer cutter to the hair introduction opening of the thinner portion; accordingly, it is not necessary to firmly press the outer cutter onto the skin, and it is possible to cut the hair smoothly and with appropriate shaving depth simply by lightly touching the outer cutter to the skin and moving around the shaver.

Furthermore, the sliding surface where the cutter blades of the inner cutter make a sliding contact with the inner cutter running track of the outer cutter is positioned on a plane (or flat surface) that is perpendicular to the center axis line; accordingly, grinding of the cutting surfaces of the inner cutter running tracks and cutter blades of the inner cutter can be done easily. In other words, since the cutter blades of the inner cutter and the inner cutter running track of the outer cutter are not curved, grinding can be done with a whetstone that has a planar grinding face, and repairing (reviving) the grinding face of the whetstone can be done easily.

In the present invention, the vertical cross-sectional shape of the top portion of the outer cutter (in cross section on an imaginary radial plane that includes the center axis line that is the rotational center of the inner cutter) is made constant (or can be the same) for the entire circumference, and it can be vary in the circumferential direction. For example, the top portion of the outer cutter can be formed so that only the ring-shaped groove side (or the portions near or alongside the ring-shaped groove) where overly deep shaving is likely to occur is made thinner (or thicker) than the circumferential portions so as to prevent overly deep shaving.

Furthermore, in the present invention, the outer cutter of a cutter unit can be formed so that a part of the top portion thereof in the circumferential direction is thin on the ring-shaped groove side (or thin near or alongside the ring-shaped groove) with the other part of the top portion being thick. For example, by way of forming the outer circumferential edge of the top portion of the outer cutter where wrinkles in the skin are likely to occur thicker than the other portions, it is possible to prevent overly deep shaving from occurring at such thick circumferential edge.

For example, in an outer cutter housing that has a plurality of cutter units, the thickness of the top portion of the outer cutter is thin at the ring-shaped groove side (or near or alongside the ring-shaped groove) on the outer circumferential side of the outer cutter housing where the outer cutter is likely to be firmly pressed against skin, and the thickness is made large (or thick) on the center side of the outer cutter housing where the outer cutter is likely to come into contact with the skin perpendicularly. In a shaver with three cutter units installed in a triangular shape, the same effect as describe above is obtained by making the thickness of the areas of the top portions of the outer cutters located outside a triangle formed by connecting the centers of each cutter unit (or the outer cutters) small (thinner) on the ring-shaped groove side (or near or alongside the ring-shaped groove). The areas located inside the triangle, the thickness of the outer cutter top portion can be large at the ring-shaped groove side, or the top portions in such areas can be made flat with no thick or thin portions.

DETAILED DESCRIPTION OF THE INVENTION

Figure 1:
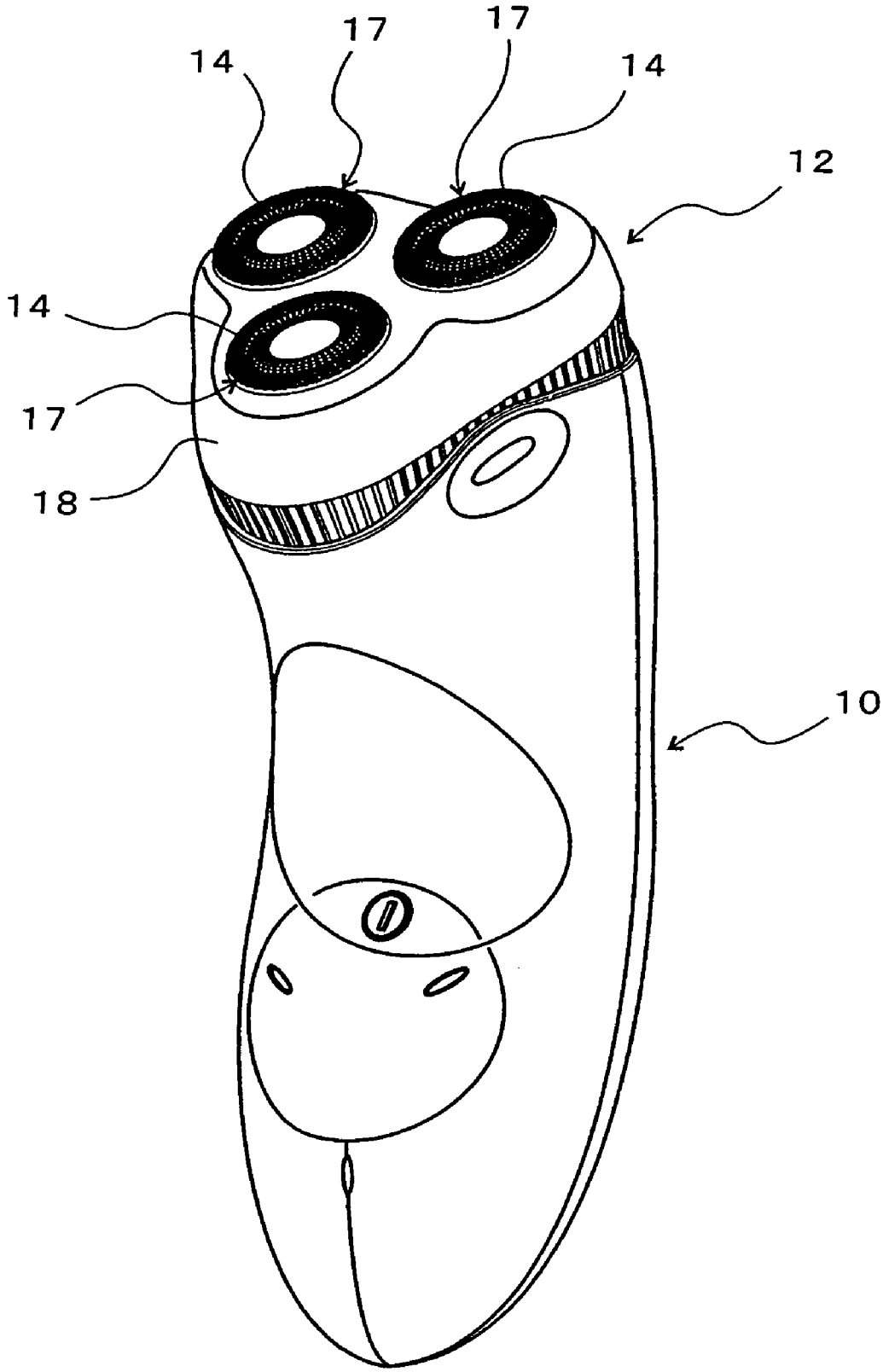
FIG. 1 is an exterior perspective view of the rotary type electric shaver according to one embodiment of the present invention.

In FIG. 1, the reference numeral 10 is a shaver main body, and 12 is a cutter head openably or detachably mounted on the shaver main body 10. Three cutter units 17 each comprising an outer cutter 14 and an inner cutter 16 (see FIG. 3) are provided in the cutter head 12. The outer cutters 14 of the three cutter units 17 are positioned with their centers at the vertices of an equilateral triangle.

The cutter head 12 includes an outer cutter housing 18 that is openable or detachable upward relative to the shaver main body 10, and the outer cutters 14 are installed in three outer cutter installation holes formed in the outer cutter housing 18. Each cutter unit 17 that includes the outer cutter 14 is upwardly urged; in other words, it is urged in the direction that the outer cutter 14 projects upward in FIG. 1.

Figure 2:
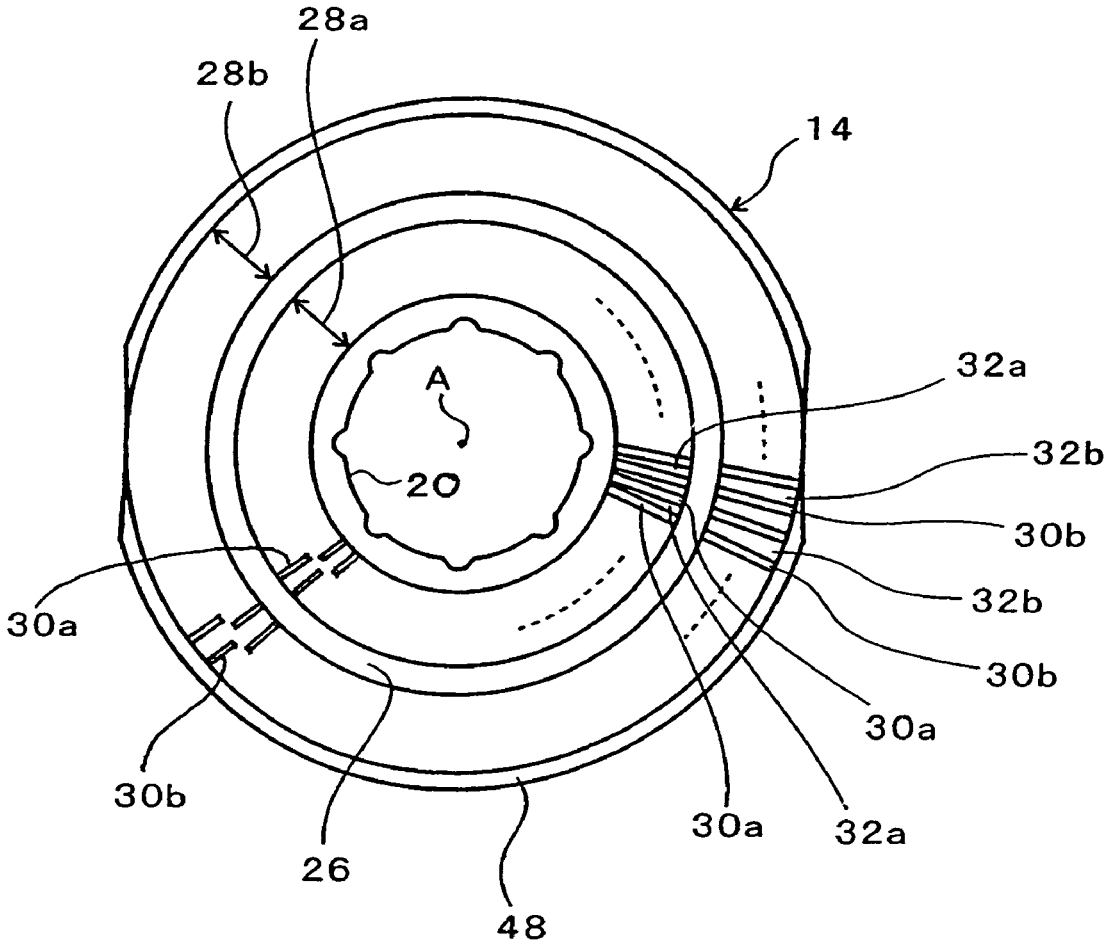
FIG. 2 is a front view of an outer cutter used in the shaver of the present invention.
Figure 3:
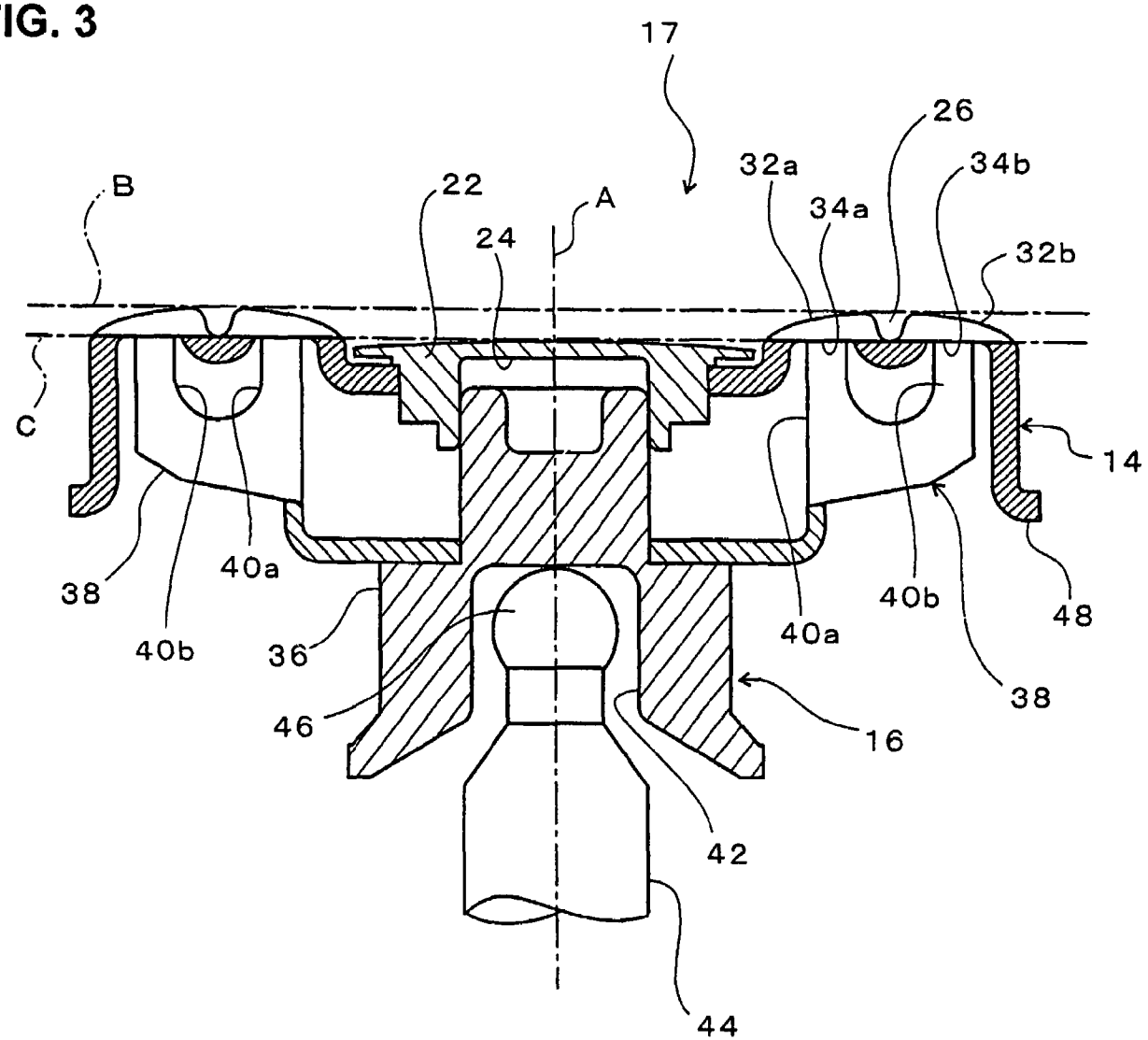
FIG. 3 is a side cross-sectional view of the cutter unit used in the shaver of the present invention.

As seen from FIGS. 2 and 3, the outer cutter 14, which is made of metal, is in substantially a shallow bowl shape. The top portion of the outer cutter 14 is circular, and a substantially round opening 20 is formed in the center. A cap 22 is fitted in this round opening 20 from above. An engagement recess 24 is, as seen from FIG. 3, formed in the bottom of the cap 22, so that the tip end of the boss 36 of the inner cutter 16, which will be described later, engages the engagement recess 24, preventing the axial vibration of the inner cutter 16.

As shown in FIG. 2, a single ring-shaped groove 26 is formed in the circular top portion of the outer cutter 14. The groove 26 is concentric with the center axis line A that is a rotational center of the inner cutter 16. Blade formation regions 28*a* and 28*b*, which form circular shaving surfaces, are formed as an inner and outer pair sandwiching the ring-shaped groove 26 so that the inner and outer blade formation regions 28*a* and 28*b* are located on both sides of the ring-shaped groove 26.

A plurality of slit-shaped hair introduction openings 30*a* and 30*b*, which respectively transect the blade formation regions 28*a* and 28*b* from the center axis line A (see FIG. 2), are formed in the top portion of the outer cutter 14 in substantially the radial direction. More specifically, the hair introduction openings 30*a* and 30*b* are formed along straight lines at a constant angular inclination relative to a radial straight line passing through the center axis line A in FIG. 2. The lower surfaces of ribs 32*a*, which are between the adjacent hair introduction openings 30*a*, and of the ribs 32*b*, which are between the adjacent hair introduction openings 30*b*, form outer cutter blades that work together with the inner cutter 16 for cutting the hair. The inner and outer hair introduction openings 30*a* and 30*b* are formed so as to transect each one of the blade formation regions 28*a* and 28*b* in the radial direction (from the inner circumferential edge to the outer circumferential edge of each one of the blade formation regions 28*a* and 28*b*); however, they can be formed so that they open up to substantially halfway through each one of the blade formation regions 28*a* and 28*b* in, for example, a staggered layout as referred to by 30*a*' and 30*b*' in FIG. 2.

Figure 4:
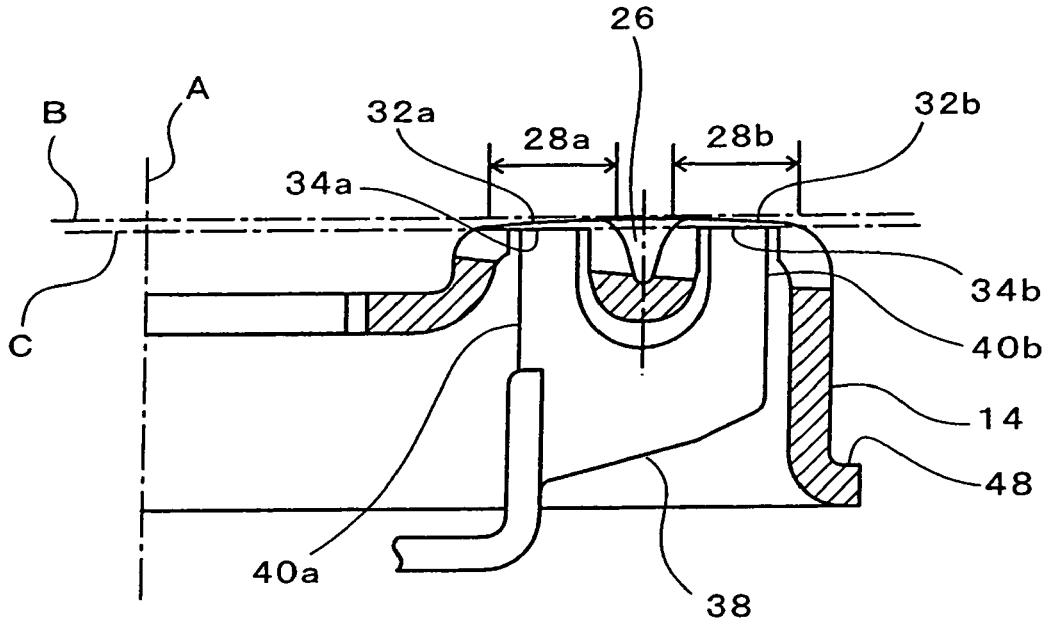
FIG. 4 is an enlarged cross-sectional illustration showing a part of the cutter unit.

As seen from FIG. 3, the top portion of the outer cutter 14, or the top portion of the ribs 32*a* and 32*b*, has a curved surface which is substantially convex upward so that, in a vertical cross section that is a cross section on an imaginary radial plane passing through the center axis line A as shown in FIGS. 3 and 4, the portion which is on the ring-shaped groove 26 side (or the portion near or alongside the ring-shaped groove 26) is high or large in thickness, and it gradually becomes lower or smaller in thickness in the direction away from the ring-shaped groove 26 (or toward the inner and outer circumferential edges of the top portion). More specifically, with respect to a (imaginary) flat plane B, which is orthogonal to the center axis line A (the center axis line A being a perpendicular line in FIG. 3), the thickness of the blade formation regions 28*a* and 28*b* is formed so that it is larger (thicker) near the ring-shaped groove 26 and is smaller (thinner) at the circumferential portions distant from the ring-shaped groove 26, and this thickness difference between the portions near the ring-shaped groove 26 (where it is thicker) and the portions at the circumferences distant from the ring-shaped groove 26 (where it is thinner) is consistent for the entire blade formation regions 28*a* and 28*b* in the circumferential direction. As a result, the vertical cross sectional shape of the entire blade formation regions (or the ribs) as shown in FIG. 3 is the same for the entire circumference of the top portion of the outer cutter 14.

The lower surfaces of the blade formation regions 28*a* and 28*b* of the outer cutter 14 (in other words, the lower surfaces of the ribs 32*a* and 32*b*) make inner cutter running tracks (ring-shaped tracks) 34*a* and 34*b*, respectively. These inner cutter running tracks 34*a* and 34*b* are provided so that, when viewed from the side (as viewed in FIG. 3), their interior surfaces (track surfaces or bottom surfaces) lie on a (imaginary) flat plane C that is orthogonal to the center axis line A, and this (imaginary) flat plane C corresponds to the lower surfaces of the ribs 32*a* and 32*b*.

The inner cutter 16, as seen from FIG. 3, includes a resin boss 36, which opens downward, and a plurality of blade bodies 38, which surround the boss 36 and equidistantly fixed circumferentially. The blade bodies 38 can be connected into a ring shape single body. Each blade body 38 is bifurcated so as to have two cutter blades 40*a* and 40*b* which respectively make sliding contact from below with the inner cutter running tracks 34*a* and 34*b* of the outer cutter 14. In other words, the inner cutter running tracks 34*a* and 34*b* (of the under surface of the top portion) of the outer cutter 14 and the cutter blades 40*a* and 40*b* of the outer cutter 14 define a sliding surface. The upper edges of the cutter blades 40*a* and 40*b* form blades or cutting edges that are ground horizontally along the above-described flat plane C.

An connection bore 42 that opens downward and has a quadrilateral shape when seen in plan view (or when seen from below) is formed inside the boss 36 of the inner cutter 16, and drive shaft 44 that projects from the shaver main body 10 is engaged with the connection bore 42. More specifically, the upper end of the drive shaft 44 has a spherical engagement head 46 of a quadrilateral shape (in plan view), and this spherical engagement head 46 is brought into the connection bore 42 of the boss 36 of the inner cutter 16 from below. The drive shaft 44 is rotationally driven by a motor (not shown in the drawing) installed inside the shaver main body 10, and it rotates the inner cutter 16.

The drive shaft 44 is movable up and down in its axial direction or has a property of making a reciprocating motion in the upward projecting direction, so that the drive shaft 44 presses the inner cutter 16 upward or against the outer cutter 14. Therefore, the cutter blades 40*a* and 40*b* of the inner cutter 16 are elastically pressed against the inner cutter running tracks 34*a* and 34*b* of the outer cutter 14 from below.

The outer cutter 14 is formed with a circumferential flange 48 along the lower edge of its cylindrical portion so as to project radially outward. The flange 48 is engaged with an outer cutter installation hole (not shown in the drawing) of the outer cutter housing 18 from below, so that the cutter unit 17 that is comprised of the outer cutter 14 and the inner cutter 16 is elastically depressible downward (or toward the shaver main body 10) with respect to the outer cutter housing 18.

As seen from the above, in the structure described above, the top portion of the outer cutter 14 corresponding to the inner cutter running tracks 34*a* and 34*b*, in other words, the top portions of the ribs 32*a* and 32*b*, is higher (or thicker in thickness) on the ring-shaped groove 26 side (or near or alongside the ring-shaped groove 26), and it becomes lower at the portions distant from the ring-shaped groove 26 (so that the thickness of the top portion of the outer cutter becomes thinner toward the inner and outer circumferential edges). Therefore, when skin is perpendicular to the top surface of the outer cutter 14 and the top surface of the outer cutter 14 is pressed against the skin along the flat plane B, the skin first makes contact with the thick portion (or near the ring-shaped groove 26). As a result, even if the skin enters the hair introduction openings 30*a* and 30*b*, it does not reach the cutter blades 40*a* and 40*b* of the inner cutter 16, thus not being cut by the inner cutter 16.

During shaving, hair enters into the hair introduction openings 30*a* and 30*b* from this thick portion near the ring-shaped groove 26. If the outer cutter 14 (or the shaver) is moved on the surface of the skin (or moved along the curvature of the skin), hair is guided by the hair introduction openings 30*a* and 30*b* and moved to the circumferential thin portions (the portion distant from the ring-shaped groove 26). Therefore, hair is cut at the thin portions with appropriate depth. In other words, shaving can be done smoothly and with appropriate depth by lightly touching and moving the outer cutter 14 without firmly pressing it against the skin.

Figure 5:
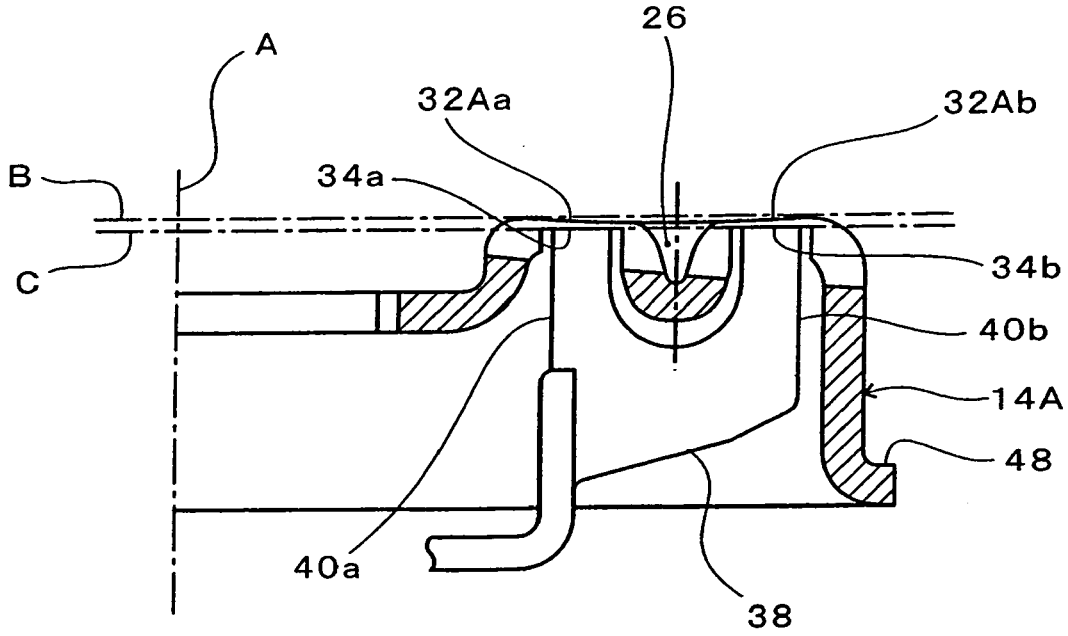
FIG. 5 is an enlarged cross-sectional illustration showing a part of the cutter unit according to another embodiment of the present invention.

FIG. 5 shows another embodiment of the present invention.

As seen from FIG. 5 which is a cross-section of the same portion as in the structure of FIG. 4, in the outer cutter 14A of this embodiment, the thickness of the top portion of the outer cutter 14A, more specifically, the thickness of the ribs 32A*a* and 32A*b*, is formed to be thin on the ring-shaped groove 26 side (or thin near or alongside the ring-shaped groove 26 so that the height of the top portion is reduced) and the portion distant from the ring-shaped groove 26 is formed to be thick (so that the height of the top portion is increased). In other words, as seen from FIG. 5, the top portion of the outer cutter 14, or the top portion of the ribs 32A*a* and 32A*b*, has a curved surface which is substantially concave so that, in a vertical cross section that is a cross section on an imaginary radial plane passing through the center axis line A as shown in FIGS. 3 and 4, the portion which is on the ring-shaped groove 26 side (or the portion near or alongside the ring-shaped groove 26) is low or small in thickness, and it gradually becomes higher or larger in thickness in the direction away from the ring-shaped groove 26 (or toward the inner and outer circumferential edges of the top portion). More specifically, with respect to the (imaginary) flat plane B, which is orthogonal to the center axis line A (the center axis line A being a perpendicular line in FIG. 5), the thickness of the blade formation regions is formed so that it is smaller (thinner) near the ring-shaped groove 26 and is larger (thicker) at the circumferential portions distant from the ring-shaped groove 26.

In this structure, when the outer cutter 14A is pressed against the skin perpendicularly, the skin first touches the thick portions which are distant from the ring-shaped groove 26 (thick portions being the inner circumferential portion of the inner rib 32A*a* and the outer circumferential portion of the outer rib 32A*b*). At these portions, since the ribs 32A*a* and 32A*b* are thick, the skin does not reach the cutter blades 40*a* and 40*b* of the inner cutter, and there is no risk for the skin to be damaged during shaving. If the outer cutter 14 (or the shaver) is moved along the flat plane B, hair that has enter the hair introduction opening is guided by the hair introduction opening and moved toward the ring-shaped groove 26. In this portion, the rib has a small thickness or is thin; accordingly, hair is cut deeply. Shaving can be done without firmly pressing the thin portion of the outer cutter to the skin, and overly deep cutting can be avoided.

The structure shown in FIG. 5 effectively works where wrinkles are likely to occur in the skin touching the outer circumferential edge of the outer cutter 14A when the outer cutter 14A (or the shaver) is moved. This is because the outer cutter 14A is thick near the outer circumferential edge where wrinkles can occur on the skin, and the skin hardly reaches the cutter blade 40*b* of the blade body 38.

Figure 6:
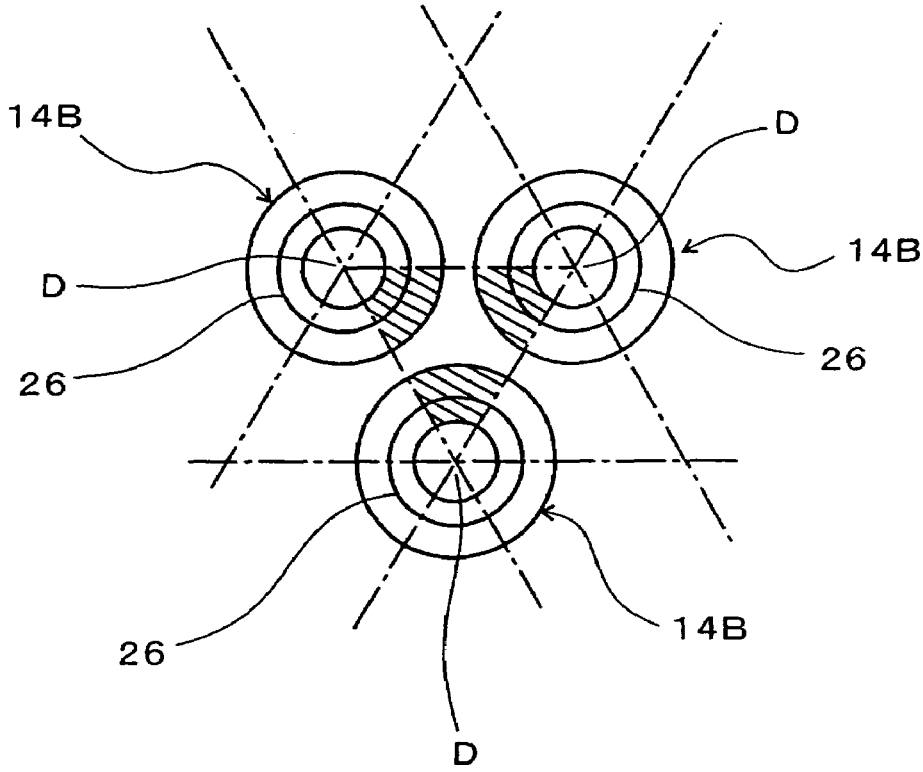
FIG. 6 is an illustration showing the arrangement of the outer cutters in the present invention.
Figure 7:
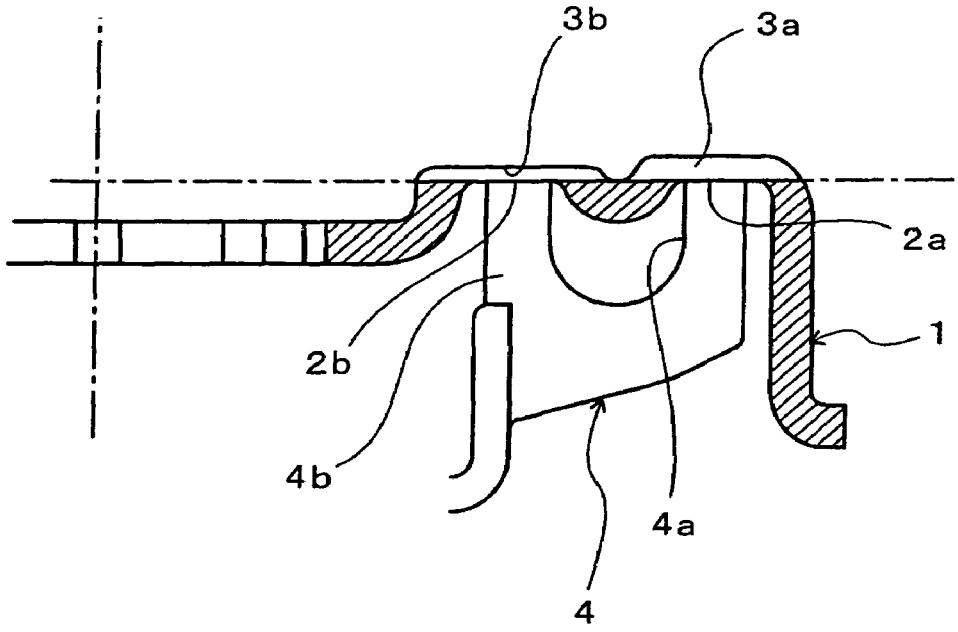
FIG. 7 PRIOR ART
FIG. 7 is a side cross-sectional view of a related art.

FIG. 6 shows the outer cutters 14B (or three cutter units 17) arranged in the outer cutter housing according to another embodiment of the present invention.

These three outer cutters 14B are arranged with their centers D in an equilateral triangle. In each outer cutter 14B, the areas of the top portions of the outer cutters 14B inside the triangle defined by the three centers D (the shaded portion) have the structure shown in FIG. 4, and the areas of the top portions outside the triangle have the structure shown in FIG. 5. In other words, in each one of the outer cutters 14B, the shaded area is thicker on the ring-shaped groove 26 side (or thicker near or alongside the ring-shaped groove) and thinner in the portions distant from the ring-shaped groove 26 (or thinner along the circumference); and the unshaded area is thinner on the ring-shaped groove 26 side (or thinner near or alongside the ring-shaped groove) and thicker in the portion distant from the ring-shaped groove 26 (or thicker along the circumference).

With the structure described above, even if the skin wrinkles because of the outer circumferential edge of the outer cutter 14B when the outer cutter 14B (or the shaver) is moved on the skin, since the outer cutter is thinner on the ring-shaped groove 26 side (or thinner along the ring-shaped groove) and thicker at portions distant from the ring-shaped groove 26 (or thicker along the circumferences), the skin is prevented from reaching the cutter blade of the inner cutter, and there is no risk for the skin to be damaged. When the area near the center of the triangle defined by the three centers D of the outer cutters 26 is pressed against the skin, the hair is guided into the hair introduction openings from the ring-shaped groove 26 side (where the rib is thick), moved to the portion distant from the ring-shaped groove 26 (where the rib is thin), and then shaved there with sufficient depth. Thus, the structure shown in FIG. 6 is a combination of the structures of FIG. 4 and FIG. 5 made in view of the manner of occurrence of wrinkles.

The invention claimed is:

1. A rotary type electric shaver comprising:

a shaver main body:

an outer cutter housing provided on said shaver main body;

a cutter unit comprised of an outer cutter provided in said outer cutter housing, said outer cutter having a circular top portion with a plurality of slit-shaped hair introduction openings extending in substantially a radial direction formed therein: and an inner cutter disposed inside said outer cutter and rotationally driven by a motor provided inside said shaver main body: wherein the outer cutter is formed with a ring-shaped groove, which is formed in said top portion and concentric wit a center axis line that forms a rotational center of said inner cutter, and two ring-shaped inner cutter running tracks, which are formed in an interior surface of said outer cutter so as to be concentric with said center axis line and on both sides of said ring-shaped groove.

said inner cutter is provided with a plurality of cutter blades that make sliding contact with track surfaces of said inner cutter running tracks, a sliding surface defined by said track surfaces of said inner cutter tracks and said cutter blades of said inner cutter is positioned on an plane perpendicular to said center axis line, and a thickness of at least a portion of each of said two ring-shaped inner cutter running tracks from near said ring-shaped groove in said top potion of said outer cutter to an inner and an outer circumferential portion of said top portion for at least part of a circumferential direction of said outer cutter varies; and wherein said portions of said two ring-shaped inner cutter running tracks near said ring-shaped groove are larger in thickness than said circumferential portions.

2. The rotary type electric shaver according to claim 1, wherein a plurality of cutter units are provided in said outer cutter housing.

3. The rotary type electric shaver according to claim 2, wherein three cutter units are provided so that centers thereof form a triangle, and a part of top portion of each one of said outer cutters which is outside a triangle formed by connecting centers of said cutter units is thinner near said ring-shaped groove than other part of said top portion.

* * * * *